US008297741B2

(12) United States Patent
Kirihara

(10) Patent No.: US 8,297,741 B2
(45) Date of Patent: Oct. 30, 2012

(54) LIQUID EJECTING APPARATUS

(75) Inventor: Daisuke Kirihara, Chino (JP)

(73) Assignee: Seiko Epson Corporation, Tokyo (JP)

( * ) Notice: Subject to any disclaimer, the term of this patent is extended or adjusted under 35 U.S.C. 154(b) by 223 days.

(21) Appl. No.: 12/883,381

(22) Filed: Sep. 16, 2010

(65) Prior Publication Data

US 2011/0069123 A1 Mar. 24, 2011

(30) Foreign Application Priority Data

Sep. 18, 2009 (JP) ..... 2009-217772

(51) Int. Cl.
*B41J 2/05* (2006.01)

(52) U.S. Cl. ..... 347/60; 347/17; 347/14; 347/19; 347/13; 347/42

(58) Field of Classification Search ..... 347/12, 347/13, 14, 17, 19, 40, 42, 56, 57, 60
See application file for complete search history.

(56) References Cited

U.S. PATENT DOCUMENTS

| | | | | |
|---|---|---|---|---|
| 8,109,592 | B2 * | 2/2012 | Eguchi et al. | 347/17 |
| 2005/0174374 | A1 * | 8/2005 | Ebihara et al. | 347/13 |

FOREIGN PATENT DOCUMENTS

| | | |
|---|---|---|
| JP | 11-028826 | 2/1999 |
| JP | 2004-243267 | 9/2004 |
| JP | 2005-022294 | 1/2005 |
| JP | 2007-001036 | 1/2007 |
| JP | 2009-137091 | 6/2009 |

* cited by examiner

*Primary Examiner* — Juanita D Jackson
(74) *Attorney, Agent, or Firm* — Workman Nydegger

(57) ABSTRACT

The liquid ejecting heads are arranged on the head carrying member such that each pair of nozzles that are next to each other in terms of first-direction positions of adjacent ones of the liquid ejecting heads are shifted relative to each other by an offset length δ corresponding to a relative displacement in the first direction between the liquid ejecting heads due to thermal expansion during liquid ejection with reference to a specified pitch at which nozzles included in a single nozzle row are provided.

3 Claims, 4 Drawing Sheets

LIQUID EJECTING APPARATUS

The entire disclosure of Japanese Patent Application No: 2009-217772, filed Sep. 18, 2009 are expressly incorporated by reference herein.

BACKGROUND

1. Technical Field

The present invention relates to liquid ejecting apparatuses including recording heads of, for example, ink jet type, and in particular to a liquid ejecting apparatus including a plurality of liquid ejecting heads.

2. Related Art

Liquid ejecting apparatuses refer to apparatuses including liquid ejecting heads and configured to eject various kinds of liquid from the liquid ejecting heads. An image recording apparatus such as an ink jet recording apparatus (hereinafter simply referred to as a printer) is an exemplary typical liquid ejecting apparatus. The printer includes an ink jet recording head (hereinafter simply referred to as a recording head) functioning as a liquid ejecting head and performs recording by ejecting droplets of ink in a liquid state from the recording head toward an object of ejection, such as recording paper, and causing the droplets to land on the object, thereby forming dots. In recent years, liquid ejecting apparatuses have been applied not only to image recording apparatuses but also to various manufacturing apparatuses such as display manufacturing apparatuses.

The printer includes a recording head (serial head) having a shorter width than a recording medium (object of liquid ejection) such as paper or resin film, a head moving mechanism that moves the recording head back and forth in a head scanning direction, a transportation mechanism that performs sub-scanning by transporting the recording medium in a direction orthogonal to the head scanning direction, and so forth. The printer records an image or the like onto the recording medium by alternately repeating ink ejection from the recording head performed during main scanning and transportation of the recording medium (sub-scanning). In such a method, however, the speed at which the recording head is scanningly moved is limited. Therefore, in a case where, for example, an image is to be recorded on the entirety of a relatively large recording medium, it takes a correspondingly long time to complete the recording.

To solve such a problem, a recently proposed recording apparatus (JP-A-2009-137091) includes a head unit in which a plurality of recording heads are provided in a first direction on a carriage, the recording heads each having a nozzle group including nozzles arranged in a plurality of rows extending in the first direction. The overall first-direction length of the nozzle groups provided in the plurality of recording heads corresponds to the maximum recordable width of a recording medium. The recording apparatus ejects ink while moving the head unit in a second direction crossing (ideally, orthogonal to) the first direction but without moving the head unit in the first direction relative to the recording medium. Such a configuration realizes a shorter recording time than in the case where a serial head is employed.

In the printer that performs recording with a plurality of recording heads, however, the intervals between the recording heads fixed on the carriage may change because of thermal expansion of the recording heads and/or the carriage included in the head unit due to changes in the ambient temperature and/or heat generation from the recording heads. If the temperature inside the printer becomes higher than the ambient temperature obtained during a manufacturing process of attaching the recording heads onto the carriage and the intervals between adjacent ones of the recording heads, for example, recording heads A and B shown in FIG. 6, increase from those determined in the manufacturing process, the positions of the nozzles of the recording heads A and B are shifted relative to each other from those shown by broken lines to those shown in solid lines. Consequently, the landing positions of ink droplets on the recording medium are displaced from the originally expected positions, and the density of dots becomes uneven. Such unevenness in dot density may appear as unwanted lines in the image recorded on the recording medium, deteriorating the quality of recording. Such a problem often occurs when an image is printed in a single color of ink with a plurality of recording heads.

SUMMARY

An advantage of some aspects of the invention is that there is provided a liquid ejecting apparatus in which the occurrence of failure due to thermal expansion of a head unit with a rise of temperature inside the apparatus is prevented.

According to an aspect of the invention, a liquid ejecting apparatus includes a head unit in which a plurality of liquid ejecting heads are provided in a first direction on a head carrying member. The liquid ejecting heads each have a nozzle group including a plurality of nozzles from which liquid is ejected toward an object of liquid ejection. The nozzles are lined in the first direction at a specific pitch. The head unit is configured to eject the liquid from the nozzles while moving in a second direction crossing the first direction relative to the object of liquid ejection.

The liquid ejecting heads are arranged on the head carrying member such that each pair of nozzles that are included in a nozzle group intended for a same type of liquid and are next to each other in terms of first-direction positions of adjacent ones of the liquid ejecting heads are shifted relative to each other by an offset length δ corresponding to a relative displacement in the first direction between the liquid ejecting heads due to thermal expansion during liquid ejection with reference to a specified pitch at which nozzles included in a single nozzle row are provided.

The relative displacement refers to the relative displacement in the first direction between the liquid ejecting heads due to thermal expansion occurring with a change in the temperature inside the apparatus from the ambient temperature to a specified temperature that is expected to be obtained during printing, the ambient temperature being obtained in the process of manufacturing the head unit including attaching of the liquid ejecting heads onto the head carrying member.

The offset length δ is determined in accordance with the relative displacement. The offset length δ may be equal to the relative displacement, or may include a small difference from the relative displacement considering errors in the displacement and other factors.

In the above configuration, the liquid ejecting heads are arranged on the head carrying member such that each pair of nozzles that are next to each other in terms of first-direction positions of adjacent ones of the liquid ejecting heads are shifted relative to each other by the offset length δ corresponding to the relative displacement in the first direction between the liquid ejecting heads due to thermal expansion during liquid ejection with reference to the specified pitch at which nozzles included in a single nozzle row are provided. Therefore, during liquid ejection, the nozzles that are next to each other in terms of first-direction positions of adjacent liquid ejecting heads are aligned at the specified pitch in the first direction because of thermal expansion. Accordingly, the intervals of dots formed on the object of liquid ejection become constant. Consequently, the unevenness in dot density is reduced, and, for example, the occurrence of unwanted lines in an image or the like formed on the object of liquid ejection is prevented.

In the above configuration, it is preferable that liquid ejection be prevented from being started until a temperature inside the apparatus reaches a level at which adjacent ones of the liquid ejecting heads are displaced relative to each other in the first direction by the length δ because of thermal expansion.

In such a case, immediately after the start of liquid ejection, the nozzles that are next to each other in terms of first-direction positions of adjacent liquid ejecting heads are aligned at the specified pitch in the first direction because of thermal expansion. Accordingly, the landing positions of dots are prevented from being displaced.

In the above configuration, it is also preferable that the liquid ejecting apparatus further include a heater, and that liquid ejection be started after an interior of the apparatus is heated by the heater until a temperature inside the apparatus reaches a level at which adjacent ones of the liquid ejecting heads are displaced relative to each other in the first direction by the length δ because of thermal expansion.

In such a case, thermal expansion of the head carrying member and the liquid ejecting heads is intentionally made to occur, whereby the pitch of the liquid ejecting heads is changed to the specified pitch as quickly as possible. Thus, liquid ejection can be started more quickly.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of the invention will now be described with reference to the drawings. Although the embodiment described below includes various limitations as preferable examples of the invention, the scope of the invention is not limited to such examples unless otherwise described below. The following embodiment concerns an image recording apparatus, which is an example of a liquid ejecting apparatus, and more specifically, an ink jet printer (hereinafter referred to as a printer) including a plurality of ink jet recording heads (hereinafter simply referred to as recording heads) functioning as liquid ejecting heads.

Figure 1A:
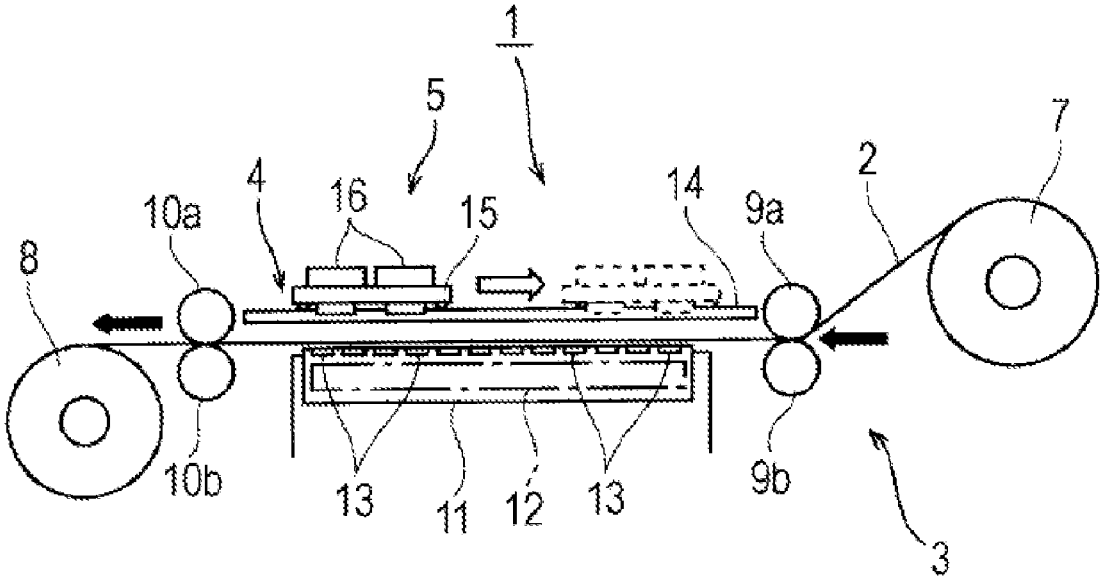
FIG. 1A is a schematic side view of a printer.
Figure 1B:
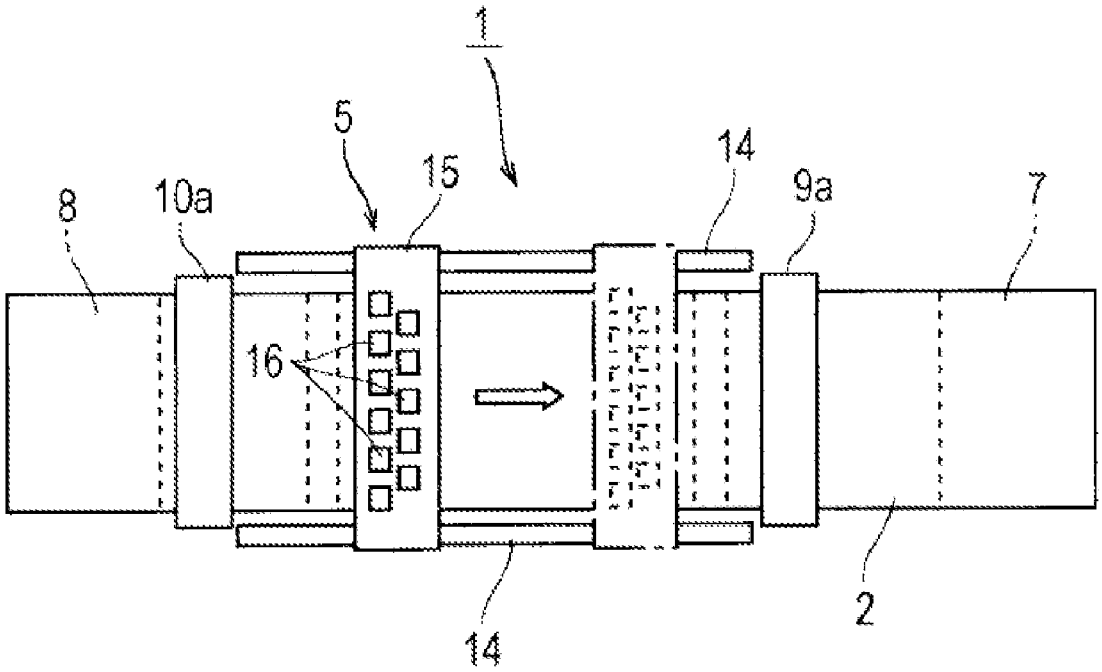
FIG. 1B is a schematic plan view of the printer.

FIGS. 1A and 1B schematically show a printer 1 according to an embodiment of the invention. FIG. 1A is a schematic side view of the printer 1. FIG. 1B is a schematic plan view of the printer 1. The printer 1 according to the embodiment prints unit images onto a foil of printing tape 2, i.e., a recording medium (object of ejection), by ink jet method. The printing tape 2 having such unit images is later cut out for use as seal-type labels to be pasted onto packages and jars intended for food products and so forth. The printing tape 2 is roll paper (continuous form paper) lined with release paper. The printer 1 prints images to be used as labels successively in a direction in which the printing tape 2 continues.

The printer 1 according to the embodiment basically includes a control unit (a printer controller, not shown), a transportation unit 3, a drive unit 4, and a head unit 5. The transportation unit 3 transports the printing tape 2 in the direction in which the printing tape 2 continues (the second direction according to the invention and hereinafter also referred to as the transportation direction) from a feed roll 7 provided on the upstream side toward a winding roll 8 provided on the downstream side (as indicated by black arrows shown in FIG. 1A). The transportation unit 3 includes upper and lower feed rollers 9*a* and 9*b*, upper and lower delivery rollers 10*a* and 10*b*, a suction table 11, and so forth. The feed rollers 9*a* and 9*b* are rotated by a drive motor (not shown) with the printing tape 2 nipped therebetween, thereby feeding the printing tape 2 from the feed roll 7 toward the suction table 11, i.e., a printing area.

During printing, the suction table 11 supports the printing tape 2 from the back of the printing tape 2, i.e., from a side opposite a printing surface on which ink droplets land. The suction table 11 has in the entirety of the upper surface thereof a number of suction holes 13. During printing, suction is applied to the printing tape 2 fed to the upper surface of the suction table 11 by a suction mechanism (not shown) from below through the suction holes 13 such that the printing tape 2 comes into close contact with the upper surface of the suction table 11. The suction table 11 has thereinside a platen heater 12. The platen heater 12 heats, as described below, the atmosphere inside the printer 1 before printing is performed until the temperature inside the printer 1 reaches a specific level, and heats the printing tape 2 so as to promote drying of the image or the like printed on the printing tape 2.

The delivery rollers 10*a* and 10*b* are rotated by the drive motor (not shown) with the printing tape 2 nipped therebetween and deliver the printing tape 2 that has undergone printing from the printing area toward the winding roll 8. The printing tape 2 delivered from the printing area is wound into the winding roll 8.

The drive unit 4 is a moving mechanism that moves the head unit 5 in the transportation direction in which the printing tape 2 is transported, i.e., the second direction (a head scanning direction). The drive unit 4 includes two guide rails 14 extending in the transportation direction. The two guide rails 14 are provided on respective ends, respectively, of the suction table 11 in a first direction. The head unit 5 is movable in the head scanning direction along the guide rails 14.

While the head unit 5 guided along the guide rails 14 is being moved by the drive unit 4 in the head scanning direction, the head unit 5 ejects ink toward the printing tape 2 placed on the suction table 11 and causes the ink to land on the printing tape 2, thereby forming dots. A group of such dots forms an image or the like on the printing tape 2. The head unit 5 includes a carriage 15, which is a head carrying member, carrying a plurality (n) of recording heads 16.

Figure 2:
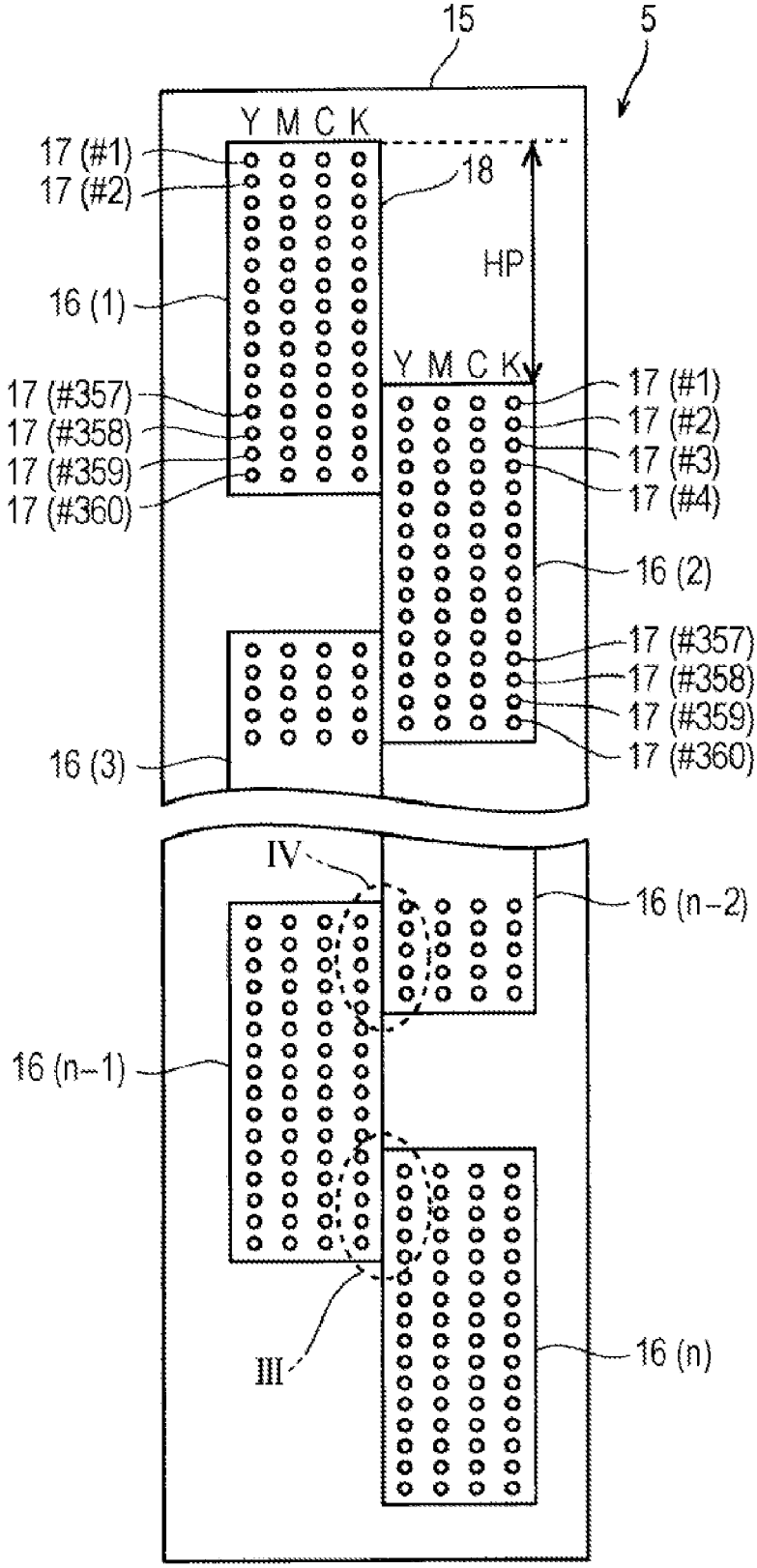
FIG. 2 is a plan view of a head unit seen from the side of a nozzle surface.

FIG. 2 is a plan view of the head unit 5 seen from the bottom (the side of a nozzle surface 18).

Referring to FIG. 2, the recording heads 16 (16(1) to 16(n)) are arranged on the carriage 15 at regular intervals in the first direction (the longitudinal direction in FIG. 2) crossing the head scanning direction (the lateral direction in FIG. 2). Adjacent ones of the recording heads 16 are provided alternately at two different positions in terms of the head scanning direction. The recording heads 16 are arranged such that ink can be ejected over the entire width of the printing tape 2 with a single scanning motion of the head unit 5, that is, the overall length of rows of nozzles 17 provided in the recording heads 16 becomes larger than the width of the printing tape 2.

The recording heads 16(1) to 16(n) include pressure chambers communicating with the nozzles 17 and pressure generators (for example, piezoelectric vibrators and heaters, not shown) configured to produce changes in the pressure applied to the ink in the pressure chambers. The recording heads 16(1) to 16(n) perform printing (liquid ejection) in which ink (an example of the liquid according to the invention) is ejected from the nozzles 17 and is caused to land on the printing tape 2 in accordance with drive signals supplied from the control unit to the pressure generators so as to drive the pressure generators.

The recording heads 16 each have in the nozzle surface 18 thereof a plurality of nozzle rows (nozzle groups) in which the nozzles 17 from which ink is ejected are lined in the first direction. In the embodiment, a single recording head 16 has four nozzle rows provided side by side in the head scanning direction. A single nozzle row includes, for example, 360 nozzles 17(#1) to 17(#360) arranged at a pitch corresponding to 360 dpi, i.e., at intervals of 70 μm. Each recording head 16 has nozzle rows for the number of different types, or colors, of ink. In the embodiment, each recording head 16 has four nozzle rows for four respective colors of ink: yellow ink (Y), magenta ink (M), cyan ink (C), and black ink (K). The four nozzle rows are provided side by side in the head scanning direction.

Figure 3:
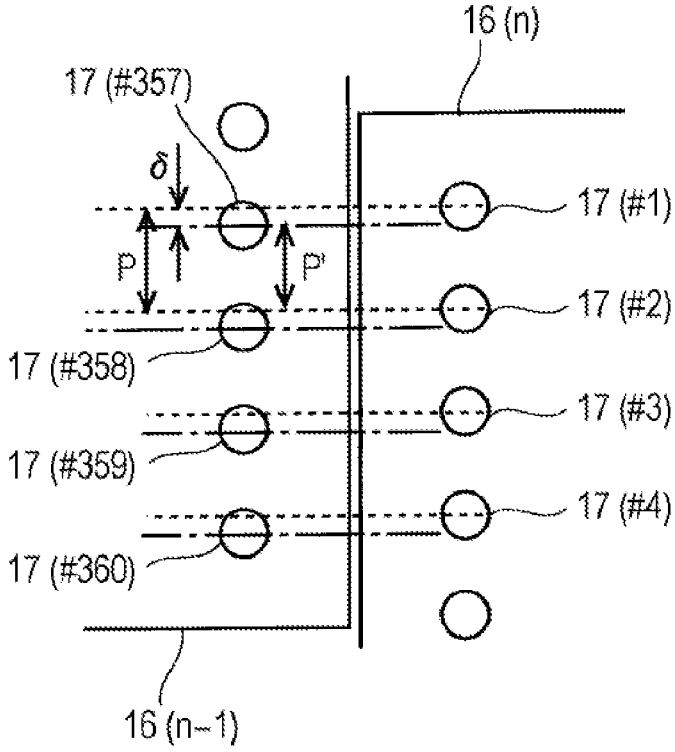
FIG. 3 is a schematic diagram showing the positional relationship between nozzles in overlapping portions at ends of nozzle rows in different recording heads provided adjacent to each other.
Figure 4:
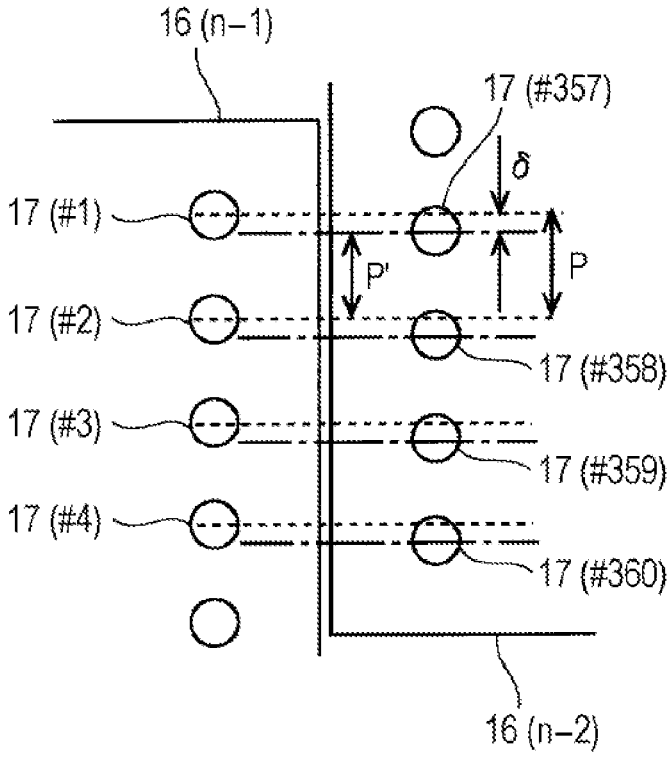
FIG. 4 is another schematic diagram showing the positional relationship between nozzles in overlapping portions at ends of nozzle rows in different recording heads provided adjacent to each other.

FIG. 3 is an enlarged plan view of part III shown in FIG. 2. FIG. 4 is an enlarged plan view of part IV shown in FIG. 2. FIGS. 3 and 4 show exemplary positional relationships between nozzles 17 of a pair of recording heads 16(n) and 16(n-1) and between nozzles 17 of another pair of recording heads 16(n-1) and 16(n-2), respectively. Nozzles 17 of the other pairs of adjacent recording heads 16 are also arranged with the positional relationship described below in which nozzle rows of adjacent ones of the recording heads 16 overlap each other at the ends thereof.

Referring to FIG. 3, the nozzle rows of a pair of adjacent recording heads 16 overlap each other at the ends thereof in the first direction. In the embodiment, between the adjacent recording heads 16, four nozzles 17(#1), 17(#2), 17(#3), and 17(#4) at the end on one first-direction side (the upper side in FIGS. 2 and 3) of the nozzle row in the recording head 16(n) provided on the other first-direction side (the lower side in FIGS. 2 and 3) overlap, in terms of first-direction positions, four nozzles 17(#357), 17(#358), 17(#359), and 17(#360) at the end on the other first-direction side of the nozzle row in the recording head 16(n-1) provided on the one first-direction side. In such overlapping portions, the nozzle 17(#357) of the recording head 16(n-1) corresponds to the nozzle 17(#1) of the recording head 16(n), the nozzle 17(#358) of the recording head 16(n-1) corresponds to the nozzle 17(#2) of the recording head 16(n), the nozzle 17(#359) of the recording head 16(n-1) corresponds to the nozzle 17(#3) of the recording head 16(n), and the nozzle 17(#360) of the recording head 16(n-1) corresponds to the nozzle 17(#4) of the recording head 16(n).

Referring to FIG. 4, four nozzles 17 at the end on the one first-direction side of the nozzle row in the recording head 16(n-1) and four nozzles 17 at the end on the other first-direction side of the nozzle row in the recording head 16(n-2) also overlap and correspond to each other. Specifically, a nozzle 17(#1) of the recording head 16(n-1) corresponds to a nozzle 17(#357) of the recording head 16(n-2), a nozzle 17(#2) of the recording head 16(n-1) corresponds to a nozzle 17(#358) of the recording head 16(n-2), a nozzle 17(#3) of the recording head 16(n-1) corresponds to a nozzle 17(#359) of the recording head 16(n-2), and a nozzle 17(#4) of the recording head 16(n-1) corresponds to a nozzle 17(#360) of the recording head 16(n-2).

As a matter of convenience, FIGS. 3 and 4 each show the correspondence between the nozzle row (the nozzle row for black ink (K) in the embodiment) on the rightmost side (the most upstream side in the transportation direction) of the recording head 16 on the left side and the nozzle row (the nozzle row for yellow ink (Y) in the embodiment) on the leftmost side (the most downstream side in the transportation direction) of the recording head 16 on the right side. Actually, the above correspondence applies to each pair of nozzle rows for the same type (color) of ink.

In addition, the number of nozzles 17 in the overlapping portion at the end of a single nozzle row of each of adjacent recording heads 16 is not limited to that described above. It is also acceptable to employ a configuration in which the nozzle rows do not overlap each other at ends thereof.

In the known art, nozzles included in a single nozzle row are provided at a specified constant first-direction pitch P, at which each pair of nozzles that are next to each other in terms of first-direction positions of adjacent recording heads are also provided. (In a configuration in which nozzle rows of adjacent recording heads overlap each other at ends thereof, the first-direction positions of the centers of overlapping ones of nozzles coincide with each other.) That is, the recording heads are arranged on the carriage such that the nozzles are provided at the specified first-direction pitch P in each of and among all of the recording heads. In such a case, when the temperature inside the printer rises during printing, the carriage and the recording heads may undergo thermal expansion, and the relative first-direction distances between adjacent recording heads may be increased, changing the pitch of nozzles from the specified pitch P. Consequently, the density of dots formed on the printing tape may become uneven, and the quality of a printed image or the like may be deteriorated.

In the printer 1 according to the embodiment of the invention, the recording heads 16 are arranged on the carriage 15 such that each pair of nozzles 17 that are next to each other in terms of first-direction positions of adjacent ones of the recording heads 16 (i.e., nozzles 17 that are next to each other supposing that the nozzles 17 were not offset with respect to each other: for example, in FIG. 3, the nozzle 17(#357) of the recording head 16(n-1) and the nozzle 17(#2) of the recording head 16(n)) are offset with respect to each other by an offset length δ in such a direction that the two nozzles 17 come close to each other. The offset length δ is determined on the basis of the relative displacement in the first direction between adjacent recording heads 16 due to thermal expansion of the carriage 15 and the recording heads 16 occurring during printing. That is, each pair of nozzles 17 that are next to each other in terms of first-direction positions of adjacent ones of the recording heads 16 are shifted relative to each other in the first direction by the offset length δ corresponding to the relative displacement in the first direction between the recording heads 16 due to thermal expansion during printing with reference to a specified pitch (70 μm in the embodiment) at which nozzles 17 included in a single nozzle row are provided. Hence, a first-direction pitch P' at which each pair of nozzles 17 that are next to each other in terms of first-direction positions of adjacent ones of the recording heads 16 are provided is expressed as P−δ.

The relative displacement between the recording heads 16 refers to the relative displacement between the recording heads 16 due to thermal expansion occurring with a change in the temperature inside the printer 1 by ΔT° C., i.e., from the ambient temperature (23° C., for example) to a specified temperature that is expected to be obtained during printing, the ambient temperature being obtained in the process of manufacturing the head unit 5 including attaching of the recording heads 16 onto the carriage 15. Specifically, when the length of the carriage 15 in the first direction is denoted by L; the pitch of the recording heads 16 is denoted by HP; the coefficient of linear expansion of the carriage 15 is denoted by α (1/° C.); and the coefficient of linear expansion of the recording heads 16 is denoted by β (1/° C.), the displacement D is expressed as $D=(\alpha\times L\times\Delta T)+(\beta\times HP\times\Delta T)$. The offset length δ is determined considering the displacement D. For example, the offset length δ may be equal to the displacement D (δ=D) in the first direction between the recording heads 16 due to thermal expansion during printing, or the offset length δ may include a small difference from the displacement D (δ=D+α) considering the relative displacement between the recording heads 16 due to errors in the displacement and other factors. In the embodiment, δ=D is employed.

The operation of the printer 1 configured as above will now be described.

The head unit 5 stands by at a home position before printing is started. In the embodiment, the platen heater 12 heats the atmosphere inside the printer 1 until the temperature inside the printer 1 reaches the specified level (the specified temperature at which adjacent ones of the recording heads 16 are displaced relative to each other in the first direction by the length δ because of thermal expansion). The heating causes thermal expansion of the carriage 15 and the recording heads 16, whereby the pitch of the recording heads 16 is changed to the specified pitch P as quickly as possible. Thus, printing can be started more quickly. When printing is started, the head unit 5 is scanningly moved by the drive unit 4 along the guide rails 14 in the transportation direction from the downstream side toward the upstream side. An exemplary case will now be described where a plurality of line patterns each formed by dots of a specific color lined in the first direction are printed successively in the head scanning direction (the second direction) with the scanning movement of the head unit 5 so that a specific region of the printing tape 2 is printed solid.

Figure 5:
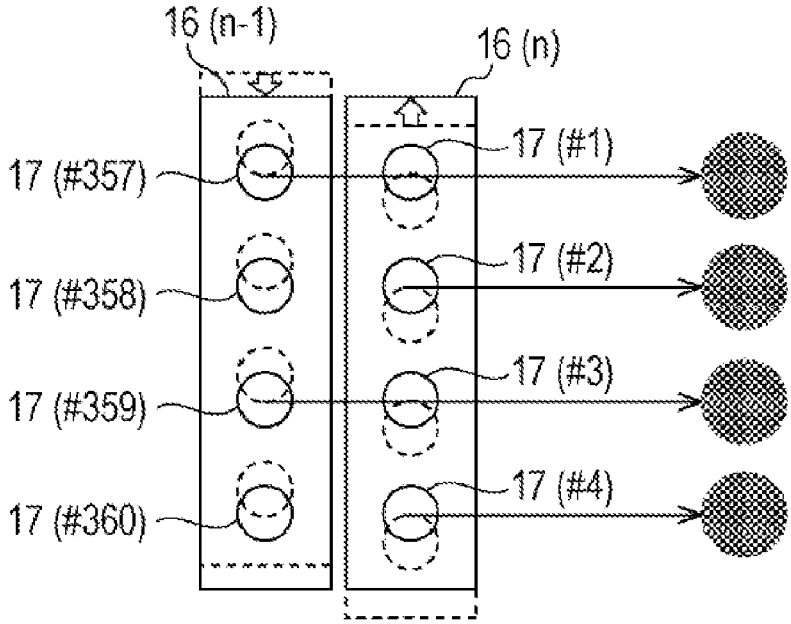
FIG. 5 is a schematic diagram showing how part of a line pattern is formed with the nozzles in the overlapping portions at the ends of the nozzle rows in different recording heads provided adjacent to each other.
Figure 6:
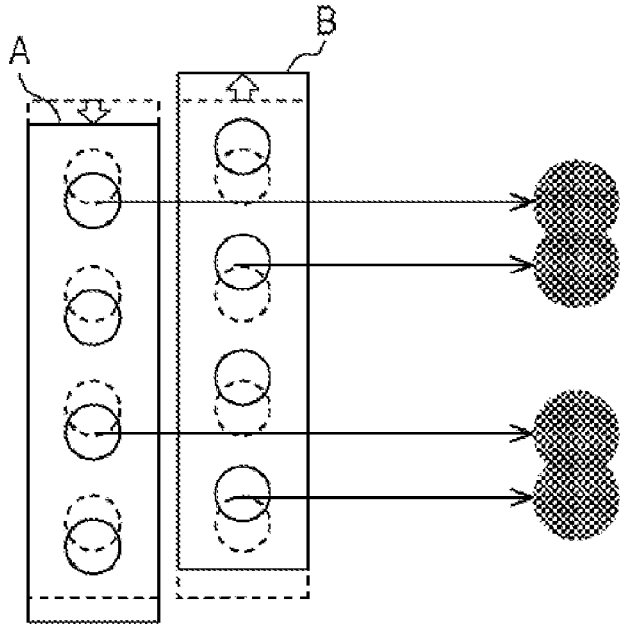
FIG. 6 is a schematic diagram showing how part of a line pattern is formed with nozzles in overlapping portions at ends of nozzle rows in different recording heads provided adjacent to each other in a known apparatus.

FIG. 5 is a schematic diagram showing how part of a line pattern is printed with the nozzles 17 in the overlapping portions at the ends of two nozzle rows for black ink (K) in two respective recording heads 16 provided adjacent to each other. Referring to FIG. 5, to print part of a line pattern with such nozzles 17 in the overlapping portions, the ink is first ejected from the nozzles 17 of even numbers (the nozzle 17(#2) and the nozzle 17(#4) in FIG. 5) of one of the recording heads 16 provided on the leading side in the head scanning direction (the recording head 16(n) in FIG. 5), thereby forming dots on the printing tape 2. Subsequently, after the head unit 5 and the printing tape 2 are relatively moved by the length corresponding to the distance in the second direction between the two nozzle rows, the ink is ejected from the nozzles 17 of odd numbers (the nozzle 17(#357) and the nozzle 17(#359) in FIG. 5) in the other recording head 16 provided on the trailing side in the head scanning direction (the recording head 16(n-1) in FIG. 5), thereby forming dots on the printing tape 2. Alternatively, the ink may be ejected first from the nozzles 17 of odd numbers (the nozzle 17(#1) and the nozzle 17(#3) in FIG. 5) of the recording head 16 provided on the leading side in the head scanning direction, thereby forming dots on the printing tape 2, and subsequently from the nozzles 17 of even numbers (the nozzle 17(#358) and the nozzle 17(#360) in FIG. 5) in the recording head 16 provided on the trailing side in the head scanning direction, thereby forming dots on the printing tape 2.

Thus, the dots formed on the printing tape 2 with the ink ejected from the adjacent recording heads 16 are lined in the first direction, whereby a line pattern formed by such a group of dots and extending in the first direction is printed. In the printer 1 according to the embodiment of the invention, each pair of nozzles 17 that are next to each other in terms of first-direction positions of adjacent ones of the recording heads 16 are shifted relative to each other by the offset length δ corresponding to the relative displacement in the first direction between the recording heads 16 due to thermal expansion during printing with reference to the specified pitch P at which nozzles 17 included in a single nozzle row are provided. Therefore, during printing, the nozzles 17 that are next to each other in terms of first-direction positions of adjacent recording heads 16 are aligned at the specified pitch P in the first direction because of the thermal expansion. Accordingly, the intervals of dots formed on the printing tape 2 become constant. Consequently, the unevenness in dot density is reduced, and the occurrence of unwanted lines in the printed image or the like is prevented.

The arrangement of the recording heads 16, the number of recording heads 16, and the like are not limited to those described in the embodiment, and any configuration may be employed.

The embodiment concerns a configuration in which the platen heater 12 heats the atmosphere inside the printer 1 until the temperature reaches the specified level. The invention is not limited to such a configuration, and may be applied to a configuration without the platen heater 12 and in which printing is not started until the temperature inside the printer reaches the specified level.

The invention may also be applied to liquid ejecting heads such as a colorant ejecting head intended for the manufacturing of color filters of liquid crystal displays and the like; an electrode-material-ejecting head intended for formation of electrodes of organic electroluminescent (EL) displays, field-emission displays (FEDs), and the like; and a bioorganic-material-ejecting head intended for the manufacturing of biochips (biochemical devices), and liquid ejecting apparatuses including such liquid ejecting heads.

What is claimed is:

1. A liquid ejecting apparatus comprising:

a head unit in which a plurality of liquid ejecting heads are provided in a first direction on a head carrying member, the liquid ejecting heads each having a nozzle group including a plurality of nozzles from which liquid is ejected toward an object of liquid ejection, the nozzles being lined in the first direction at a specific pitch, the head unit being configured to eject the liquid from the nozzles while moving in a second direction crossing the first direction relative to the object of liquid ejection, wherein the liquid ejecting heads are arranged on the head carrying member such that each pair of nozzles that are next to each other in terms of first-direction positions of adjacent ones of the liquid ejecting heads are shifted relative to each other by an offset length δ corresponding to a relative displacement in the first direction between the liquid ejecting heads due to thermal expansion during liquid ejection with reference to a specified pitch at which nozzles included in a single nozzle row are provided.

2. The liquid ejecting apparatus according to claim 1, wherein liquid ejection is prevented from being started until a temperature inside the apparatus reaches a level at which adjacent ones of the liquid ejecting heads are displaced relative to each other in the first direction by the length δ because of thermal expansion.

3. The liquid ejecting apparatus according to claim 1, further comprising:

a heater, wherein liquid ejection is started after an interior of the apparatus is heated by the heater until a temperature inside the apparatus reaches a level at which adjacent ones of the liquid ejecting heads are displaced relative to each other in the first direction by the length δ because of thermal expansion.

* * * * *